United States Patent [19]

Schwab

[11] Patent Number: 4,559,806

[45] Date of Patent: Dec. 24, 1985

[54] BLIND RIVET SETTING TOOL

[75] Inventor: Manfred F. Schwab, Wiesbaden, Fed. Rep. of Germany

[73] Assignee: Alfred Honsel Nieten- und Metallwarenfabrik GmbH & Co., Froendenberg, Fed. Rep. of Germany

[21] Appl. No.: 528,417

[22] Filed: Sep. 1, 1983

[30] Foreign Application Priority Data

Mar. 12, 1983 [DE] Fed. Rep. of Germany ..... 3308915

[51] Int. Cl.[4] ..... B21D 9/05

[52] U.S. Cl. ..... 72/391; 72/453.17; 72/114; 408/9

[58] Field of Search ..... 72/391, 453.17, 453.19, 72/114; 29/243.53, 243.50, 243.54; 227/130; 408/9; 91/424, 427

[56] References Cited

U.S. PATENT DOCUMENTS

| | | | |
|---|---|---|---|
| 2,789,619 | 4/1957 | Wing et al. | 72/453.17 |
| 3,438,449 | 4/1969 | Smith | 227/130 |
| 3,654,792 | 4/1972 | Mead | 72/391 |
| 3,744,291 | 7/1973 | Hagerty et al. | 72/705 |
| 3,929,056 | 12/1975 | Lange | 91/424 |

*Primary Examiner*—Daniel C. Crane
*Assistant Examiner*—David B. Jones
*Attorney, Agent, or Firm*—Barnes, Kisselle, Raisch, Choate, Whittemore & Hulbert

[57] ABSTRACT

A blind rivet setting tool for setting threaded rivet nuts comprises a threaded pin for engaging the rivet, and a rotating mechanism to screw the nut on to the threaded pin before a rivet upsetting operation, and to unscrew the pin from the nut after the upsetting operation. The upsetting operation is performed by imparting an axial movement to the pin. The rotating means is actuated to screw the pin into the nut by applying an axial pressure to the tool and the pin while, when the axial load on the tool is relieved, the rotating mechanism automatically rotates the pin in the opposite direction, for disengagement of the pin from the rivet.

12 Claims, 5 Drawing Figures

BLIND RIVET SETTING TOOL

BACKGROUND OF THE INVENTION

The present invention relates generally to a blind rivet setting tool for setting threaded rivet nuts.

In a blind rivet setting tool of the kind indicated above, the tool is provided with a rotating means which can be actuated by the operator of the tool and which rotates a threaded pin or bolt member forming part of the tool, for screwing the nut on to the threaded pin. The tool also has a forward thrust or advancing means which can be actuated to produce the upsetting operation, by imparting an axial movement to the threaded pin for that purpose. A rotary direction reversing means is provided for rotating the threaded pin in the opposite direction to the direction in which it is screwed into the nut thereon, in order to unscrew the threaded pin from the rivet. In order to perform the sequence of operating procedures set out above, the tool has a first or rearward lever which is operated to rotate the threaded pin in a right-handed direction to cause the threaded pin to engage the nut. When the nut has reached a stop member, the first lever must be released, while the tool may include a slipping clutch as a safety measure in that respect. The tool also has a second lever which is disposed at the base of the tool for effecting the riveting operation, by the spindle being actuated by a compressed air piston, thereby producing an upsetting effect. When that phase in the procedure is concluded, the second lever must be released, and the first lever mentioned above, which is disposed at the rearward end of the tool, must be actuated again in order once again to rotate the threaded pin. In this phase of operation of the tool however, the threaded pin must now be rotated in the opposite direction in order to unscrew it from the threaded nut, so as to release the tool, and that is performed by means of a third actuating means, for example in the form of an additional knob or button. Apart from the design of the tool being of a complicated and expensive nature, operation of such a tool also involves considerable difficulties from the point of view of the operator.

In an endeavour to alleviate such problems, another form of such a tool provides that the operation of screwing the threaded pin into engagement with the nut is effected by applying the tool with pressure, with the rotary movement being automatically switched off when the nut comes into contact with a stop member, wherein, after the actual riveting operation has been performed, by simply pressing a knob or button, the tool is caused to produce a rotary movement in the opposite direction to the first rotary movement. In a further simplified form of the tool, the push button or knob can be omitted and, after the actual riveting operation has been performed, a vent bore is simply closed off to cause the tool to go into a phase of operation in which it produces a rotary movement in the opposite direction to the first rotary movement, thereby to unscrew the tool.

Although operation of that tool is simplified, by virtue of simply closing off a vent opening in order to initiate the unscrewing operation, such closure of the vent opening involves a special actuating action on the part of the operator, which may involve for example taking one hand off the tool in order to close the vent opening, in order thereby to initiate the unscrewing procedure.

However, a blind rivet setting tool is frequently used in situations where it has to carry out a very large number of working operations, so that special or particular actuating actions on the part of the operator, such as the action involved in closing off the vent opening as referred to above, result, in the course of time, in fatigue in the operator, give rise to error, and take up a certain amount of time in operating the tool, so that the total period of time involved in such actuating actions, when considered over a large number of operating procedures, may be of a substantial extent.

SUMMARY OF THE INVENTION

An object of the present invention is further to simplify a blind rivet setting tool.

Another object of the present invention is to provide a blind rivet setting tool which is easier to operate by minimising special manual operations to be performed on or with the tool.

Still another object of the present invention is to provide a blind rivet setting tool which operates by a sequence of motions comprising a rotary motion, a rivet upsetting motion and a further rotary motion in the opposite direction, and which provides for easily controllable reversal of the direction of rotary motion.

Yet another object of the present invention is to provide a blind rivet setting tool which is actuated in its various phases of operation by means so designed as not to require substantial strength on the part of the operator, for operating levers, while possibly also supporting the tool.

A further object of the present invention is to provide a blind rivet setting tool which makes use of natural actions and movements performed by the operator in the course of the riveting operation, to control the actuating phases of the tool.

According to the present invention, these and other objects are achieved by a blind rivet setting tool for setting threaded rivet nuts, comprising a threaded pin or bolt for screw engagement with a said nut. The tool has a rotating means which is actuable by the operator of the tool, for screwing the nut on to the threaded pin, and a thrust means which is actuable by the operator for producing the rivet upsetting operation, with an axial movement being imparted to the threaded pin. The tool further includes a means for reversing the direction of rotation of the threaded pin, whereby the threaded pin is rotated in the opposite direction to the direction required for screwing the nut on to the pin, in order thereby to unscrew the nut from the pin, after the rivet upsetting operation. The tool is so designed that the rotating means is actuated by the operator applying an axial pressure to the threaded pin toward said nut, thereby to produce screw engagement between the threaded pin and the nut, while when said axial pressure applied to the tool is relieved, by movement of the tool away from the nut the means for reversing the direction of rotation of the threaded pin automatically causes the threaded pin to be rotated in the opposite direction to disengage the threaded pin from the nut.

It will be seen therefore that the phase of producing screw engagement between the threaded pin and the rivet nut is performed by applying said axial pressure to the tool, so that there is no need for the operator to apply force, which may require some strength, to an actuating member such as a lever in order to initiate the screwing operation, while possibly also having to support the tool in the appropriate position. The above-defined design of the tool therefore makes use of the natural movement of the operator, in pressing the tool against the rivet to be set. To perform the riveting operation, it is only necessary for the operator to actuate a triggering or actuating lever while, when the rivet upsetting operation has been performed, the unscrewing movement whereby the threaded pin is disengaged from the nut is automatically triggered or initiated by relieving said axial pressure applied to the tool by moving the tool away from the nut.

In accordance with an advantageous embodiment of the tool in accordance with the principles of the present invention, the two, opposite directions of rotation of the threaded pin are controlled by means of a valve slide or spool which is disposed slidably in a housing or bore in the tool, with suitable control ports or bores associated with the spool. That arrangement desirably provides that the threaded pin is connected to the valve spool by way of a valve actuating rod. The valve spool is displaceable between a first position in which it is displaced rearwardly, that is to say, away from the front or rivet-actuating end of the tool, by virtue of the tool being applied to the workpiece in question, whereby the valve spool opens a first control port which feeds the means for rotating the threaded pin with compressed air to cause the threaded pin to rotate in the appropriate direction for screwing on the nut. When the axial pressure to the tool is relieved by movement of the tool away from the nut, the threaded pin moves forwardly towards the front end of the tool, and the valve spool follows that movement, under the connecting action of the valve actuating rod; in the forwardly displaced position, the valve spool shuts off the first control port and opens a second control port which now supplies compressed air to the means for rotating the threaded pin, in such a way as to cause the threaded pin to rotate in the direction for unscrewing the nut.

In an advantageous form of the above-defined control means, the valve spool has extension portions with coil springs disposed therearound, for urging the valve spool into the central position.

In an advantageous embodiment of the tool, the valve spool is provided, substantially at the centre thereof in the longitudinal direction, with an annular seal which divides the control chamber defined between the spool and the surrounding part of the valve housing, into first and second, or front and rear, control chambers. In the phase of operation in which the threaded pin is screwed into the nut, compressed air is introduced into the second or rear control chamber through a valve seat disposed at the rearward end of the valve spool, and from there passes into the first control port to the threaded pin rotating means, while the air is discharged by way of the second control port, the first or front control chamber, a front transverse bore in the valve housing, and a central bore or duct in the valve spool, to the rear of the tool, and through a vent opening which communicates with the central bore in the valve spool.

In the unscrewing operation, compressed air passes into the first or front control chamber, through a valve seat which is in an open condition, at the front end of the valve spool. From the front control chamber, the compressed air flows into the second control port to the threaded pin rotating means, while the air is discharged by way of the first control port, the second or rear control chamber, a rearward transverse bore and the central bore or duct in the valve spool, to the rear of the tool, where it is discharged by way of the vent bore.

In another advantageous form of the tool, in accordance with the principles of the present invention, the tool has a common compressed air supply bore or duct which communicates with the respective valve means or seats at the front and rear ends respectively of the valve spool, by way of front and rear communicating ducts.

Further objects, features and advantages of the tool in accordance with the principles of the present invention will be more clearly apparent from the following description of a preferred embodiment of the tool.

DESCRIPTION OF THE PREFERRED EMBODIMENT

Figure 1:
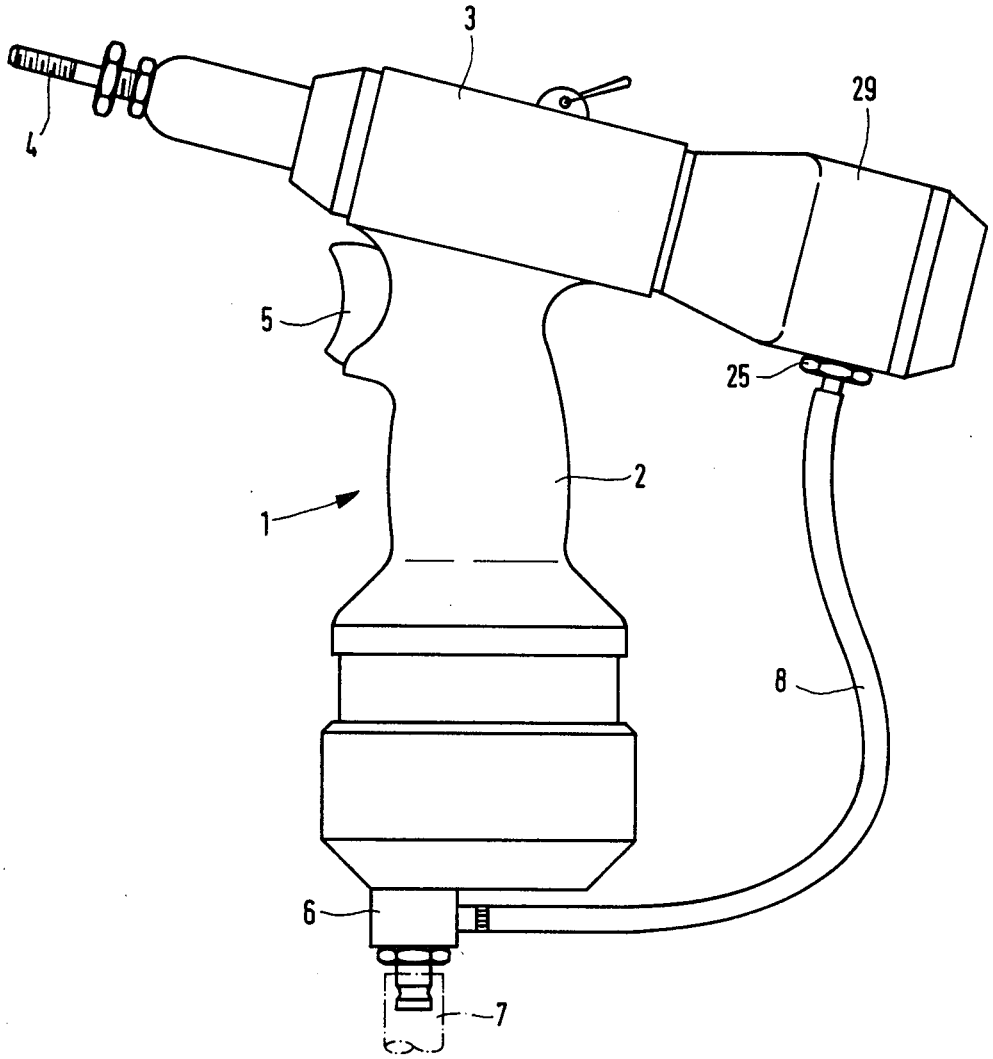
FIG. 1 shows a side view of a blind rivet setting tool, showing the external configuration thereof.

Referring firstly to FIG. 1, shown therein is a general view of a blind rivet setting tool 1 comprising a gripping or handle portion 2 and a head portion 3, which together constitute the major components of the tool. As can be seen also from FIG. 2, the head portion 3 has a front extension portion with a central aperture or bore therein, for mounting an actuating or pulling spindle 9 carrying a threaded pin 4 at the front end thereof. The threaded pin 4 is caused to rotate in the appropriate direction, for example in the right-hand direction, for screwing on to the pin a threaded rivet nut (not shown). The tool further comprises an actuating member 5 in the form of a button or lever which is operated to initiate an upsetting operation whereby an axial movement is imparted to the threaded pin 4, in the usual manner. After that phase of operation, the threaded pin 4 is rotated in the opposite direction to the initial rotary motion, in order to unscrew the nut from the threaded pin 4. The blind rivet setting tools of this type are shown, for example, in U.S. Pat. Nos. 4,275,582 and 4,275,583 which are incorporated herein by reference.

As can be clearly seen from FIG. 1, the tool has an intake connection 6 for the compressed air required for operating the tool. The compressed air is supplied to the tool from any suitable compressed air source, by way of a compressed air hose 7. The connection 6 carries compressed air on the one hand into the interior of the handle portion 2, in order to drive a pressure piston disposed therein, for the upsetting operation to be triggered by operation of the actuator member 5, and on the other hand, by way of a compressed air connecting line or conduit 8, to the rearward end of the head portion 3 of the tool, in order to drive a motor 29 carried by the head portion 3, for rotating the threaded spindle or pin 4 in different directions of rotation, as required for proper operation of the tool.

Figure 2:
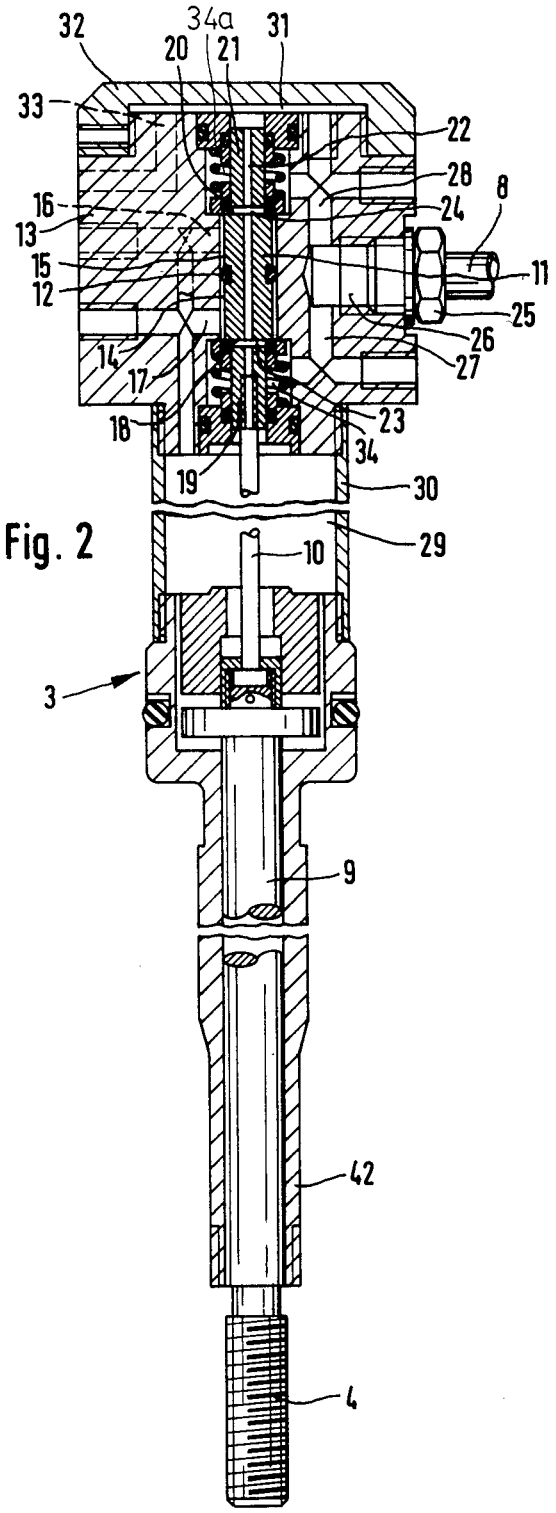
FIG. 2 shows a sectional view of the head portion of the tool shown in FIG. 1.

Reference will be made to FIG. 2 for a more detailed description hereinafter of the means for rotating the threaded pin 4 in the respective directions.

Figure 3:
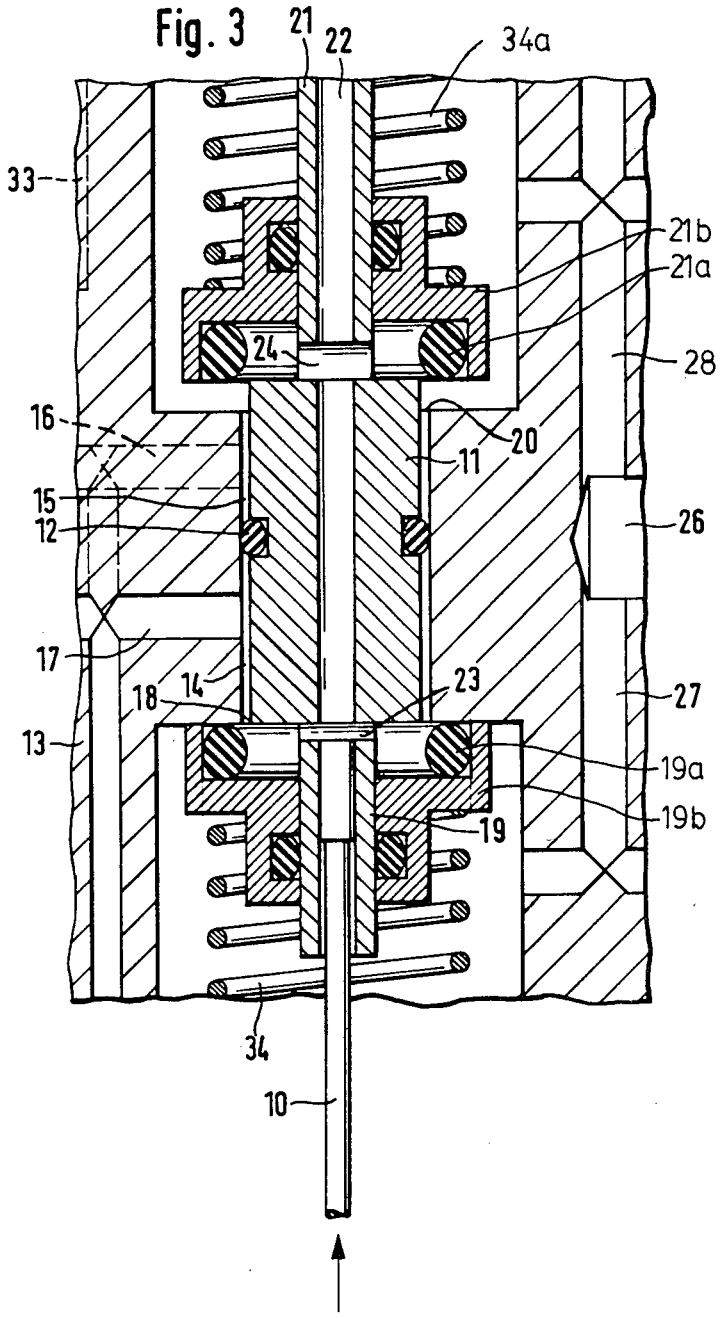
FIG. 3 is a fragmentary sectional view on an enlarged scale of a portion of the blind rivet setting tool shown in FIG. 2.
Figure 4:
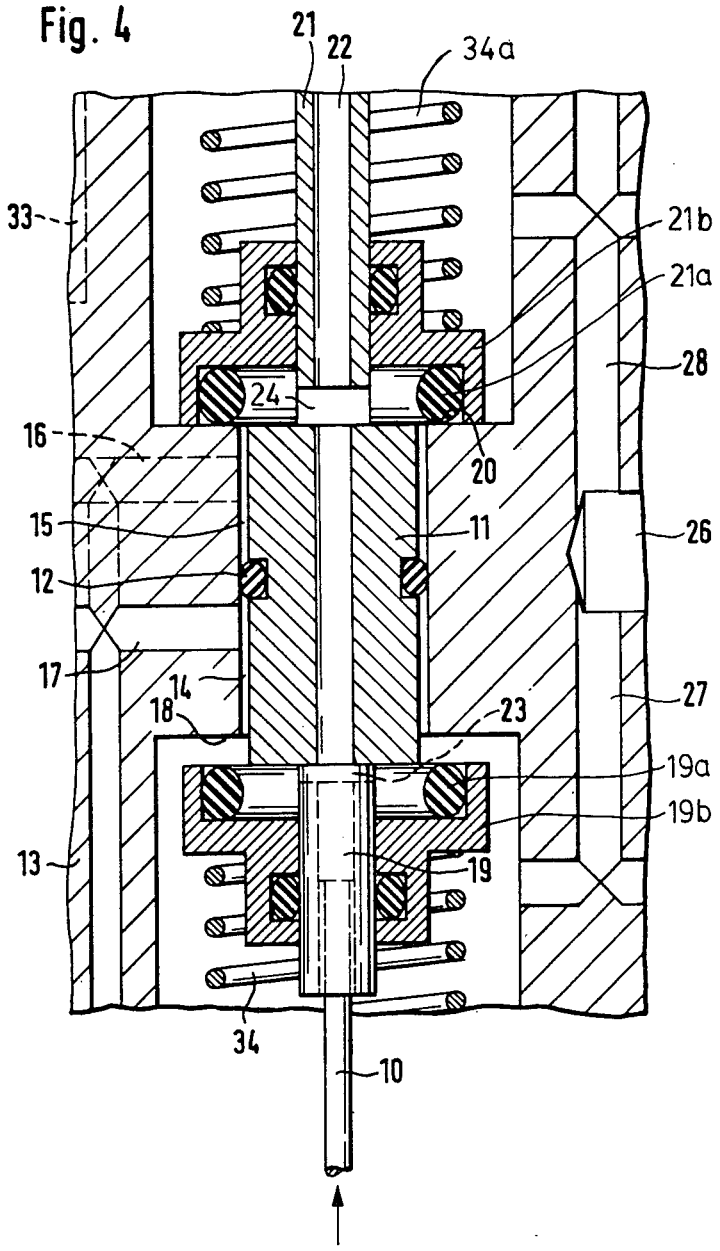
FIG. 4 is a fragmentary part sectional view similar to FIG. 3 showing the parts in a different operative position.

As shown in FIG. 2, the threaded pin 4 is secured to the front end of a traction or pulling spindle 9 which is connected by way of a valve rod 10 to a valve slide or spool 11 which is mounted slidably in a suitable bore or passage in a valve housing defined at 13 within the head portion 3 of the tool. Substantially at its centre, in the lengthwise direction thereof, the valve spool 11 carries an annular seal 12 which divides the control chamber defined between the valve spool 11 and the valve housing 13, into a first control chamber 14 and a second control chamber 15 (FIG. 3). The first control chamber 14 is disposed towards the end of the spool, which is towards the front end of the tool, that is to say, the end of the tool at which the threaded pin 4 is disposed, while the second control chamber 15 is disposed towards the end of the valve spool which is towards the rear end of the tool, that is to say, the end of the head portion 3 which is generally towards the operator, when the tool is in the position for operation thereof. The terms front and rear are therefore to be construed in relation to that orientation of the tool, in this specification.

The rear control chamber 15 communicates with a first control bore or port 16 which is shown in broken lines in FIG. 2, while the front control chamber 14 communicates with a second control bore or port 17 which is cut by the sectional plane in FIG. 2.

Provided at the front end of the valve spool 11 is a valve means formed by a valve seat indicated at 18, which is constituted by the valve spool 11 being reduced in transverse dimension to form a front extension portion 19 on the valve spool 11, while a valve seat 20 is provided in a similar fashion at the rear end of the valve spool 11, by the valve spool being reduced to form a rear extension portion 21. The valve spool 11 itself is provided with a central bore or duct 22 which extends entirely through the valve spool from end to end thereof, as can be clearly seen from FIG. 2. A front transverse bore 23 opens into the central duct 22, at the front valve seat 18, while another, rear transverse bore 24 communicates with the central duct 22 in the valve spool 11, at the rear valve seat 20. A spring 34 is associated with front valve seat 18 to tend to close the valve seat 18 and a spring **34*a* is associated with valve seat 20 to tend to close valve seal 20**.

The compressed air connecting line 8 which is shown in FIG. 1 communicates by way of a compressed air connection 25 on the head 3 of the tool, with a compressed air intake passage 26, from which the compressed air flows into a front compressed air connecting passage 27 to the front valve seat 18 and by way of a rear compressed air connecting passage 28 to the rear valve seat 20. In operation of the tool, the threaded pin 4 is caused to rotate by a drive motor 29, by way of the spindle 9, in order thereby to screw on the threaded river nut. For that purpose, an axial pressure is applied to the threaded pin 4 toward the nut, by means of the head portion 3 of the tool, with the result that the valve rod 10 is displaced rearwardly with respect to the housing 30, with corresponding rearward movement of the valve spool 11 in its housing 13 as shown in FIG. 3. That causes the valve seat 20 to be opened whereby the compressed air flows by way of the rear control chamber 15 and into the first control port 16 to the drive motor 29 in order to cause the drive motor 29 to rotate the spindle 9 in the right-hand direction, thereby to screw the nut on to the threaded pin 4. The central duct 22 with the rear transverse bore 24 is sealed against the control chamber 15 by sealing members **21*a*, which are provided in a cap 21*b*. The compressed air is discharged from the drive motor 29 by way of the second control port 17 connected thereto, into the front control chamber 14 from which it passes by way of the front transverse bore 23 into the central duct 22 in the valve spool 11. The central duct 22 communicates with a vent bore 33 (which is shown in broken lines in FIG. 2) by way of a connecting chamber 31 which is formed at the rear end of the tool between the valve housing portion 13 and a valve cover member 32**.

Figure 5:
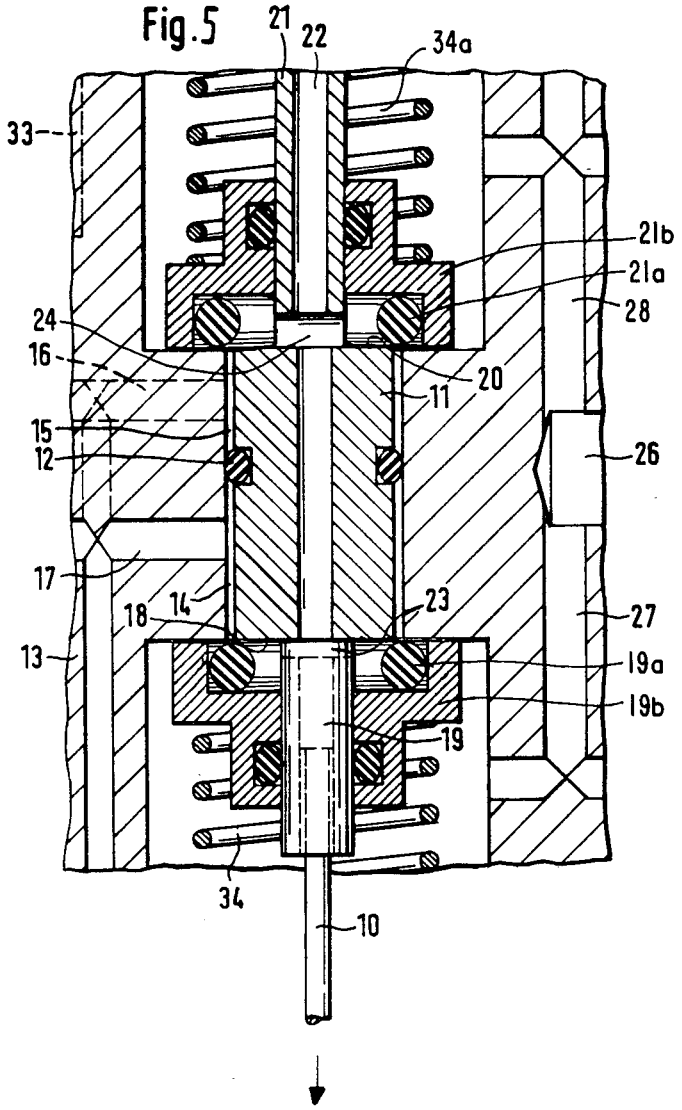
FIG. 5 is a sectional view showing the parts in a different operative position indicating that the motor will not rotate after release of the rod.

When the nut has been screwed on to the threaded pin 4, the actuating member 5 is operated in known manner to initiate the rivet upsetting operation, thereby to perform the actual riveting step, by means of a thrust or advancing means which is not described in greater detail herein but which is of conventional kind. The head portion 3 of the tool is then relieved of said axial pressure applied thereto by movement of the head relative to the pin away from the nut, so that an axial pressure is no longer applied to the threaded pin 4. When said axial pressure on the pin is relieved and said movement to the head away from the nut is imparted, the spool 11 moves in a forward direction permitting the valve seat 20 to move forwardly under the action of spring **34*a* and the valve seat 18 in a forward direction against the action of spring 34. That movement causes the rear valve seat 20 to be closed and the front valve seat 18 to be opened. As a result of that actuating movement, compressed air flows through the front communicating passage 27 and the front valve seat 18, which is in an open condition, into the front control chamber 14. From there, the compressed air passes through the second control port 17 to the drive motor 29 which is now caused to rotate the spindle 9 and the threaded pin 4 in the left-handed direction, that is to say, in the opposite direction to the rotary motion required for screwing the nut on to the threaded pin 4, so that the nut is now unscrewed from the threaded pin 4. The air is discharged from the drive motor by way of the control port 16 into the rear control chamber 15 from where it passes through the rear transverse bore 24 into the central duct 22 in the valve spool 11, and once again is discharged by way of the chamber 31 to the vent bore 33. The central duct 22 is sealed against the front control chamber 14 by sealing members 19*a* which are provided in a cap 19*b*. The central position of spool 11** blocking the compressed air supply to the motor is shown in FIG. 5.

It will be seen therefore that, when the threaded pin 4 is relieved of said axial pressure applied thereto by movement of the head relative to the pin away from the nut, after the actual riveting operation, the above-described construction causes the unscrewing movement of the threaded pin 4 to be initiated, without the need to actuate a particular actuating member for that purpose. In a riveting operation therefore, the tool only has to be applied to the workpiece with said axial pressure, whereby the tool is caused to perform a rotary motion for screwing the threaded rivet nut on to the threaded pin 4, while after the actual riveting operation has been initiated by the actuating member 5, the threaded pin 4 is relieved of said axial pressure by movement of the tool head away from the nut whereby the tool automatically performs a rotary motion in the opposite direction to unscrew the nut. That therefore provides for very easy operation of the blind rivet setting tool, by minimising the manual operations to be performed on or with the tool. It will also be seen that the above-described tool construction provides that the natural movements of the operator in applying the tool to a rivet to be upset are utilised to cause the tool to perform the appropriate sequence of operating movements, so that the operator does not require substantial strength for operating levers while also supporting the tool in the appropriate position on the rivet.

Various other modifications and alterations may be made in the above-described tool in accordance with the principles of this invention, without thereby departing from the spirit and scope of the invention.

What is claimed is:

1. A blind rivet setting tool for setting a threaded rivet nut, comprising a threaded pin engageable with a said nut for the riveting operation, a rotating means adapted to rotate said threaded pin selectively for screw engagement and disengagement of said nut, a means adapted to impart an axial movement to the threaded pin for the rivet upsetting operation, and a means for actuating said rotating means in a first direction for screwing said pin to said nut in response to an axial pressure on said pin toward said nut and for actuating said rotating means in a second direction for unscrewing said pin from said nut automatically in response to a release of said axial pressure on said pin by movement of said head away from said nut.

2. A tool as set forth in claim 1 wherein said means for actuating said rotating means in said two directions of rotary movement comprises: a housing means; a bore in the housing means; a valve spool displaceable in said bore; and first and second control ports operatively associated with said valve spool bore.

3. A tool as set forth in claim 2 and further including a valve actuating rod connecting said pin to said valve spool whereby said valve spool is displaceable into a first position in which it is displaced rearwardly of the tool by the axial pressure applied to said pin and in which it opens said first control port for supplying pressure fluid to said rotating means to produce said screwing action.

4. A tool as set forth in claim 3 wherein in response to said release of axial pressure said valve spool is displaceable into a second position in which it closes said first control port and opens said second control port and the feed of pressure fluid to the rotating means to produce said unscrewing action.

5. A tool as set forth in claim 4 wherein said valve spool has an extension portion at a first end thereof and wherein a coil spring is disposed around said extension portion, adapted to urge said valve spool towards its second position.

6. A tool as set forth in claim 2 wherein a control chamber means is defined between said valve spool and said housing means and said valve spool has a central portion bearing an annular seal means thereby to divide said control chamber into first and second chambers.

7. A tool as set forth in claim 6 wherein said tool includes a first valve seat means at a first end of the spool associated with said second chamber such that said valve spool is in a first position of opening said first control port for intake of pressure fluid, pressure fluid passes into said second chamber through said first valve seat means at said first end of the spool associated with said second chamber and thence into said first control port to said rotating means, and the fluid is discharged through a fluid flow path including said second control port and said first chamber.

8. A tool as set forth in claim 7 wherein said valve spool has a transverse bore extending transversely therein at its said first end and a central duct extending axially through the valve spool, wherein said housing means provides a vent opening adapted to be in fluid flow communication with said duct in said valve spool, whereby said discharge flow of fluid flows through said second control port, said first control chamber, said transverse bore and said valve spool duct to said vent opening.

9. A tool as set forth in claim 6 wherein said tool includes second valve seat means at a second end of the spool associated with said first chamber such that said valve spool is in a second position of opening said second control port for intake of pressure fluid, pressure fluid passes into said first chamber through said second valve seat means at said second end of the spool associated with said first chamber and thence into said second control port to the rotating means, and the fluid is discharged through a flow path including said first control port and said second chamber.

10. A tool as set forth in claim 9 wherein said valve spool has a transverse bore extending transversely therein at its said second end, and a central duct extending axially through the valve spool, wherein said housing means provides a vent opening adapted to be in fluid flow communication with said duct in said valve spool, whereby said discharge flow of fluid flows through said first control port, said second chamber, said transverse bore and said valve spool duct to said vent opening.

11. A tool as set forth in claim 6 and comprising a common pressure fluid supply conduit, and first and second connecting passages each communicating with said common supply conduit to feed pressure fluid to said first and second chambers respectively.

12. A blind rivet setting tool for setting a threaded rivet nut, comprising: a threaded pin engageable with said nut, for a rivet setting operation; a pressure fluid-actuated rotary drive means adapted to rotate said pin selectively in first and second directions for screw engagement and disengagement of said nut; a pressure fluid-actuated operator means adapted to impart an axial movement to the pin for upsetting of said rivet nut to be set; a feed conduit means for feeding pressure fluid to said operator means; an actuating member for controlling the pressure fluid feed to said operator means for actuation thereof; first and second pressure fluid flow conduit means for actuating said rotary drive means with pressure fluid; a pressure fluid flow direction control means for feeding pressure fluid to said rotary drive means through said first fluid flow conduit means adapted to cause said rotary drive means to rotate in said first direction for screwing said pin to said nut, and through said second fluid flow conduit means adapted to cause said rotary drive means to rotate in said second direction opposite to said first direction for unscrewing said pin from said nut, said flow direction control means including a valve spool displaceable in a housing bore between a first position for producing a flow of fluid such as to cause rotation of said rotary drive means in said first direction and a second position for producing a flow of fluid such as to cause rotation of said rotary drive means in said second direction; means operable by an axial force applied to said threaded pin to displace said valve spool into its first position; and means operable in response to release of said axial force on said threaded pin to displace said valve spool into its second position.

* * * * *